United States Patent [19]

Mahn et al.

[11] 4,043,800

[45] Aug. 23, 1977

[54] METHOD FOR MONITORING AND CONTROLLING THE REFINING OF CRUDE IRON

[75] Inventors: Gustav Mahn, Wolfenbuttel; Josef Schoop, Peine; Jorg Kügler, Wolfenbuttel, all of Germany

[73] Assignee: Stahlwerke Peine-Salzgitter AG, Peine, Germany

[21] Appl. No.: 517,811

[22] Filed: Oct. 24, 1974

[30] Foreign Application Priority Data

Oct. 27, 1973 Germany ..... 2354003

[51] Int. Cl.[2] ..... C21C 5/30

[52] U.S. Cl. ..... 75/60; 75/52

[58] Field of Search ..... 75/52, 60

[56] References Cited

U.S. PATENT DOCUMENTS

| | | | |
|---|---|---|---|
| 3,505,062 | 4/1970 | Woodcock | 75/60 |
| 3,663,204 | 5/1972 | Jungwirth | 75/60 |

*Primary Examiner*—Peter D. Rosenberg

*Attorney, Agent, or Firm*—Michael J. Striker

[57] ABSTRACT

Oxygen or oxygen-containing gas is blown onto a molten crude iron bath inside a converter. A layer of slag or metal-slag emulsion forms atop the molten crude iron bath and grows in height during the course of the refining reaction. The height of such layer is indirectly determined by detecting an electrical characteristic of the layer. The layer of slag or metal-slag emulsion is made to serve as the dielectric of a capacitive reactive and/or as the flux-permeable part of an inductive reactance, and such reactance, or a plurality of such reactances, form part of a resonant circuit.

7 Claims, 6 Drawing Figures

Fig. 1
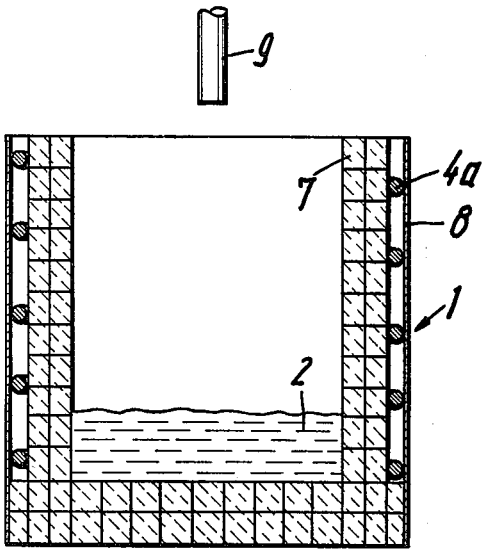
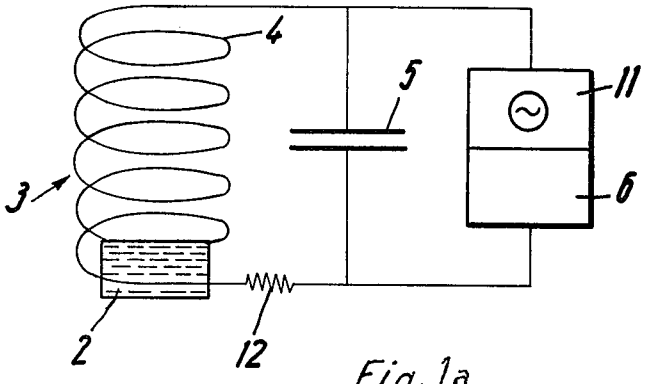
Fig. 1a

Fig. 2
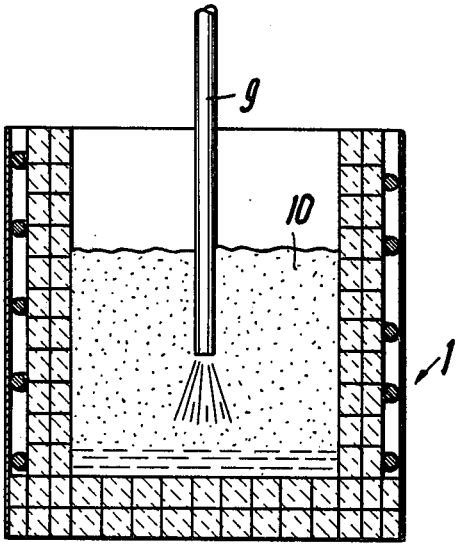
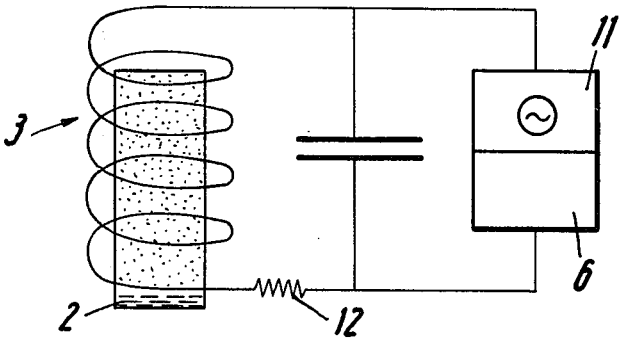
Fig. 2a

Fig. 3
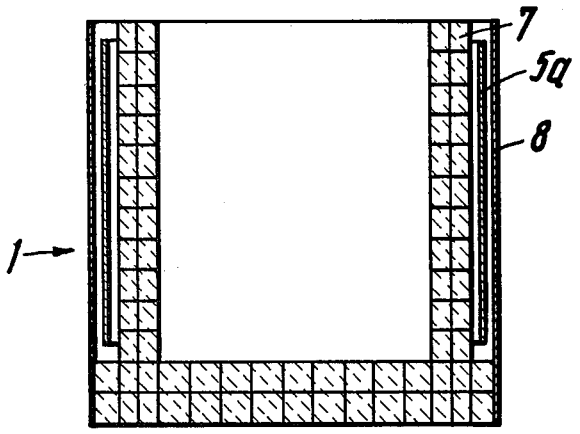
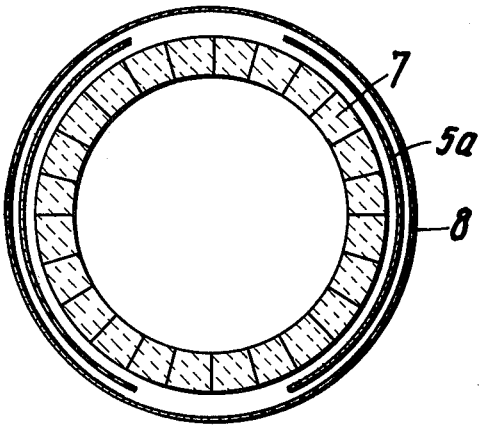
Fig. 3a

METHOD FOR MONITORING AND CONTROLLING THE REFINING OF CRUDE IRON

BACKGROUND OF THE INVENTION

The invention relates to a method and to an apparatus for monitoring and controlling the course of reaction during the refining of crude iron, the reaction being caused to occur by blowing oxygen or oxygen-containing gas onto a molten crude iron bath in a converter.

In oxidation refining processes the formation of slag constitutes one of the essential criteria of the blast process. The guidance of the lance and the supplying of the oxygen have a considerable influence on the formation of the slag.

According to the present state of the art, the operator of the blast furnace determines the growth of the layer of slag and controls the feeding of the melt mainly in dependance upon the sound level. The measurement of the sound level involves the measurement of the intensity of the noise of the blast (the discharge of $O_2$ from the discharge nozzle) as a function of time. At the start of the blast operation, the lance is moved a distance of for example 2.80 meters from the quiescent bath, and the noise intensity curve displays a high noise level. As emulsion forms, the height of the slag layer increases. During this time the lance is lowered. When the discharge nozzle of the lance dips into the slag, the noise of the blast becomes noticeably attenuated. At this moment, the height of the slag layer in the converter can be readily determined from a knowledge of the height at which the discharge end of the lance is located. During the further course of the reaction, the lance is further lowered and the slag layer continues to rise; in the extreme case, the slag can even run out through the mouth of the converter. Information concerning the exact height of the slag layer in the converter, after the slag layer has risen above the discharge nozzle of the lance, is no longer available. Upon termination of the blast operation, the slag collapses. However, the lance is at its lowermost position, and since the slag layer despite its collapse will still be above the discharge nozzle of the lance, the noise intensity curve will not show a marked change at this time.

The measurement of the noise intensity is unquestionably a useful expedient for the operator of the blast furnace during the feeding of melt, but it is no substitute for exact information concerning the height of the slag layer in the converter at all times during the course of the reaction.

SUMMARY OF THE INVENTION

It is an object of the invention to provide a method and an apparatus by means of which the level of the slag layer in the converter can be much more exactly determined than with the prior-art expedient referred to above.

This object, and others which will become more understandable from the description, below, of preferred embodiments, can be met, according to one advantageous concept of the invention, by utilizing the dielectric or magnetic-flux-permeability properties of the slag layer to vary the reactance value of one or more reactance components in an electrical resonant circuit, and indirectly determining the height of the slag layer by determining the effect of the electrical properties of the rising or falling slag layer on the reactance of the reactance components of the resonant circuit, for example by measuring the detuning of the resonance circuit, the change of the resonance frequency of the resonant circuit, or the change of the Q of the resonance circuit.

According to one advantageous concept of the invention, this method can be performed by an apparatus having the following characteristics:

a. The metal bath in the converter is surrounded by an inductor coil or by two diameterally opposed capacitor plates.

b. The length of the inductor coil or the height of the capacitor plates corresponds to at least the maximum height to which the layer of slag or metal-slag emulsion can rise.

c. The inductor coil or the capacitor plates are part of a resonant circuit containing both inductive and capacitive reactance components, with indicating means provided for indicating the extent of the detuning of the resonant circuit which results from the changes in reactance values of the reactants component(s) in part constituted by the rising layer of slag or metal-slag emulsion.

If the above arrangement is employed, then it is advantageous for the inductor coil windings or capacitor plates which centrally surround the metal bath in the converter to be built into the converter wall itself between the fireproof lining and the converter casing.

The inductor coil or capacitor plates could be subdivided into a plurality of individual inductor coils and capacitor plates. Such plurality of discrete reactance components, associated with different elevations in the interior of the converter, could be employed to digitally determine the height of the slag layer, i.e., by providing a yes-or-no indication concerning the existence of slag at the associated elevation.

Additionally, the reactance means employed could be comprised of a plurality of reactance components connected together to undergo different simultaneously reactance changes having a joint measurable effect upon the resonant circuit. Likewise, both inductive and capacitive reactances could be caused to undergo simultaneous reactance changes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a schematic longitudinal section through a converter before the blast operation;

FIG. 1a depicts schematically a resonant circuit cooperating with the arrangement shown in FIG. 1;

FIGS. 2 and 2a correspond to FIGS. 1 and 1a, but during the blast operation; and FIGS. 3 and 3a depicts a capacitive version of the invention, seen in longitudinal and transverse section, respectively.

DESCRIPTION OF THE PREFERRED EMBODIMENTS

FIG. 1 depicts a converter 1 prior to the start of the blast operation, filled with a metal bath 2. FIG. 1a depicts in schematic manner the principle of operation of the first embodiment. A resonant circuit 3 is composed of an inductor coil 4 surrounding the interior of the converter 1 and composed of coils 4*a*, and is further composed of a capacitor 5, a resistor 12, an A.C. voltage or current generator 11, and means 6 for measuring the effect upon the resonant circuit of the change in reactance of that one of the reactive circuit components which cooperates with the slag layer in the converter 1. In FIG. 1*a*, it is the inductor 4 which cooperates with the slag layer, the slag layer acting like a core for the flux of the inductor coil. Alternatively, the slag layer can cooperate with the capacitor 5, serving as the dielectric medium between the capacitor plates; this alternative version is shown in FIGS. 3 and 3*a*. Although the resonant circuit shown is comprised of only few elements, it will be understood that it could be a more complicated resonant circuit.

The means 6 for measuring the effect upon the resonant circuit of the rise or fall of the slag layer can be an ammeter, a conventional Q-meter or other conventional means for measuring the detuning of a resonant circuit. The means 6 will incorporate indicator means, for instance a visual indicator device operative for displaying the indirectly measured value of the height of the slag layer. Advantageously, the indicator device of means 6 will be calibrated directly in units of slag layer height, but it could also be calibrated in purely electrical units.

The metal bath 2 in the converter 1 is surrounded by the coils 4*a* of the inductor 4 or else by the two diametrally opposite capacitor plates 5*a*. The length of the inductor coil 4 or the height of the capacitor plates 5*a* corresponds to at least the maximum level to which the layer of slag or metal-slag emulsion 10 (see FIG. 2) can rise. The coil windings 4*a* or capacitor plates 5*a* are built into the converter 1 and located intermediate the fireproof lining 7 and the outer wall 8 of the converter, and provided with insulation. The inductor coil windings should be made of a material capable of undergoing considerable thermal expansion and contraction, for example copper.

FIG. 2 depicts how, during the blast operation, the layer of metal-slag emulsion 10 rises. In the corresponding schematic diagram of FIG. 2*a*, there is schematically depicted the rise of the slag inside the inductor, this rise of slag changing the inductance of the inductor and accordingly detuning the resonant circuit. The change of level of the slag layer is approximately proportional to the degree of detuning of the resonant circuit.

As briefly mentioned before, the resonant circuit can be influenced not only by changing the reactance of its inductor, but alternatively or additionally by changing the reactance of its capacitor. The rising of the slag layer during the course of the blast operation leads to a change in the amount of dielectric material between the capacitor plates 5*a*, and accordingly to a change in the capacitance value of the capacitor 5. This change can be measured directly or indirectly by measuring the effect of such change upon the resonant circuit, e.g., upon the resonant frequency of the circuit, upon the Q of the circuit, or upon the degree of detuning of the circuit.

The detuning of the resonant circuit 3 can be read off the indicator device of means 6. The selection of optimum frequencies and voltage or current magnitudes is dependent upon the size and diameter of the converter.

The frequency or alternatively the Q of a resonant circuit may change, as mentioned above, due to the change in the height of the slag layer. A change in the Q of the resonant circuit can result in a flattening of the resonance curve, based upon the following theoretical considerations:

By detuning of a resonant circuit is meant the change of the resonant frequency $\omega_o$ as a result of a change of the inductance L or capacitance C, according to the equation $$\omega_o^2 = 1/LC$$

Furthermore, the characteristic impedance Z of a resonance circuit is defined as:

$$Z = \omega_o L = 1/\omega_o C = \sqrt{L/C}$$

In general, in the case of a lossy resonant circuit the quality factor $Q_r$ is determinative of the shape of the resonance curve. The quality factor is determined as follows:

$$Q_r = Z/R_r = \omega_o L/R_r = 1/\omega_o C R_r$$

For a given resonant circuit, the quality factor can be determined by measuring the bandwidth between the half-power frequencies. The half-power frequencies are the frequencies at which, for a parallel-resonance resonant circuit, the impedance is 0.7 the resonance impedance.

In the drawings, reference numerals 4, 5 and 12 respectively designate the inductance L, the capacitance C and the resistance $R_r$.

It will be understood that each of the elements described above, or two or more together, may also find a useful application in other types of circuits and constructions differing from the types described above.

While the invention has been illustrated and described as embodied in particular circuits and constructions for measuring the level of the layer of slag or metal-slag emulsion in a converter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In the refining of crude metal by blowing an oxygen-comprising gas into a molten crude metal bath contained within the interior of a converter so as to cause the formation atop the molten crude metal of a layer of metal-slag emulsion which increases in height during the course of the refining, a method of measuring the height of the rising metal-slag emulsion layer during the course of the refining, so as to be able to control the blowing of the oxygen-comprising gas into the metal bath during the course of the refining in dependence upon the height of the emulsion layer, the method comprising arranging at least one reactive circuit component outside of the boundary surface of the interior of the converter so that the reactive circuit component cannot physically contact the molten crude metal in the interior of the converter, with the reactive circuit component extending up along the height of the converter and the interior of the converter also constituting the interior of the reactive circuit component, the metal-slag emulsion layer atop the metal bath in the interior of the converter and accordingly in the interior of the reactive circuit component constituting a part of the reactive circuit component, with the height of the metal-slag emulsion layer within the interior of the reactive circuit component determining the reactance of the reactive circuit component; connecting the at least one reactive circuit component to at least one further circuit component to form a resonant electricl circuit the resonance of which is dependent upon the reactance of the reactive circuit component and accordingly upon the height of the metal-slag emulsion layer within the interior of the reactive circuit component; and indirectly measuring the height of the emulsion layer by measuring the effect of the height of the layer of metal-slag emulsion upon the resonance of the resonant electrical circuit.

2. The method of claim 1, wherein the step of arranging at least one reactive circuit component outside of the boundary surface of the interior of the converter comprises arranging the electrodes of at least one capacitive circuit component outside the boundary surface of the interior of the converter, with the metal-slag emulsion layer in the interior of the converter constituting the dielectric medium of the capacitive circuit component.

3. The method of claim 1, wherein the step of arranging at least one reactive circuit component outside of the boundary surface of the interior of the converter comprises arranging the coil turns of at least one inductive circuit component outside the boundary surface of the interior of the converter, with the metal-slag emulsion layer in the interior of the converter constituting the core of the inductive circuit component.

4. In the refining of crude metal by blowing an oxygen-comprising gas into a molten crude metal bath contained within the interior of a converter so as to cause the formation atop the molten crude metal of a layer of slag which increases in height during the course of the refining, a method of measuring the height of the rising slag layer during the course of the refining, so as to be able to control the blowing of the oxygen-comprising gas into the metal bath during the course of the refining in dependence upon the height of the slag layer, the method comprising arranging at least one reactive circuit component outside of the boundary surface of the interior of the converter so that the reactive circuit component cannot physically contact the molten crude metal in the interior of the converter, with the reactive circuit component extending up along the height of the converter and the interior of the converter also constituting the interior of the reactive circuit component, the slag layer atop the metal bath in the interior of the converter and accordingly in the interior of the reactive circuit component constituting a part of the reactive circuit component, with the height of the slag layer within the interior of the reactive circuit component determining the reactance of the reactive circuit component; connecting the at least one reactive circuit component to at least one further circuit component to form a resonant electrical circuit the resonance of which is dependent upon the reactance of the reactive circuit component and accordingly upon the height of the slag layer within the interior of the reactive circuit component; and indirectly measuring the height of the slag layer by measuring the effect of the height of the layer of slag upon the resonance of the resonant electrical circuit.

5. The method of claim 1, wherein the measuring of the effect of the height of the layer of metal-slag emulsion upon the resonance of the resonant electrical circuit comprises measuring the effect of such height upon the resonance frequency of the circuit.

6. The method of claim 1, wherein the measuring of the effect of the height of the layer of metal-slag emulsion upon the resonance of the resonant electrical circuit comprises measuring the effect of such height upon the Q of the resonant electrical circuit.

7. The method of claim 1, wherein the measuring of the effect of the height of the layer of metal-slag emulsion upon the resonance of the resonant electrical circuit comprises measuring the effect of such height upon the extent of the detuning of the resonant circuit.

* * * * *